US008862341B2

(12) United States Patent
Harms et al.

(10) Patent No.: US 8,862,341 B2
(45) Date of Patent: Oct. 14, 2014

(54) VARIABLE CONTROL FOR A HYDRAULIC CIRCUIT

(71) Applicant: Barko Hydraulics, LLC, Superior, WI (US)

(72) Inventors: Scott Harms, Poplar, WI (US); Lawrence Saari, Solon Springs, WI (US); Eric Nelson, Proctor, MN (US)

(73) Assignee: Barko Hydraulics, LLC, Superior, WI (US)

( * ) Notice: Subject to any disclaimer, the term of this patent is extended or adjusted under 35 U.S.C. 154(b) by 98 days.

(21) Appl. No.: 13/838,100

(22) Filed: Mar. 15, 2013

(65) Prior Publication Data

US 2014/0260225 A1 Sep. 18, 2014

(51) Int. Cl.
*F15B 21/00* (2006.01)
*F15B 21/02* (2006.01)

(52) U.S. Cl.
CPC ..... *F15B 21/02* (2013.01)
USPC ..... 701/50; 701/36

(58) Field of Classification Search
USPC ..... 701/36, 50; 37/348, 349, 466, 350; 60/328, 368, 429, 430, 484; 91/34, 91/459, 428, 429, 461, 530
See application file for complete search history.

(56) References Cited

U.S. PATENT DOCUMENTS

| | | | | |
|---|---|---|---|---|
| 6,546,325 | B1 * | 4/2003 | Kubota et al. | 701/50 |
| 7,810,321 | B2 * | 10/2010 | Yamashita et al. | 60/328 |
| 7,985,154 | B2 * | 7/2011 | Day et al. | 475/159 |
| 2008/0296522 | A1 * | 12/2008 | Yamashita et al. | 251/65 |
| 2011/0061755 | A1 | 3/2011 | Hanakawa et al. | |

* cited by examiner

*Primary Examiner* — Richard Camby
(74) *Attorney, Agent, or Firm* — Brinks Gilson & Lione

(57) ABSTRACT

A system is provided in which a control module may include a user interface configurable to receive input and display hydraulic control settings, wherein the hydraulic control settings include at least a hydraulic pressure setting and a hydraulic flow setting. The control module may also include a processor executable to convert the hydraulic control settings to corresponding electrical currents, wherein the electrical currents correspond to at least the hydraulic pressure setting and the hydraulic flow setting. The control module may also include one or more communication interfaces coupled to the processor configurable to output the electrical currents to the hydraulic circuit to control hydraulics that operate one or more attachments of a machine.

20 Claims, 8 Drawing Sheets

VARIABLE CONTROL FOR A HYDRAULIC CIRCUIT

BACKGROUND OF THE INVENTION

The present invention generally relates to controls for hydraulics.

A hydraulic drive system can be a drive system that uses pressurized hydraulic fluid to drive hydraulic machinery. A hydraulic drive system includes of three parts: a generator, such as a hydraulic pump; plumbing; and an actuating device, such as hydraulic motor or cylinder, to drive the machinery. The hydraulic system is often used by machinery, such as an industrial tractor. The machinery may include an interface that receives an attachment tool. For example, an industrial tractor may have an arm with an interface for receiving attachment tools, such as drills, shovels, mulching heads, snow blowers, mowers and jackhammers.

SUMMARY

A system is provided in which a control module may include a user interface configurable to receive input and display hydraulic control settings, wherein the hydraulic control settings include at least a hydraulic pressure setting and a hydraulic flow setting. The control module may also include a processor executable to convert the hydraulic control settings to corresponding electrical currents, wherein the electrical currents correspond to at least the hydraulic pressure setting and the hydraulic flow setting. The control module may also include one or more communication interfaces coupled to the processor configurable to output the electrical currents to the hydraulic circuit to control hydraulics that operate one or more attachments of a machine.

The hydraulic circuit may control the hydraulics by communicating with a pressure control solenoid and a flow control solenoid. The pressure control solenoid may control a pressure limiting valve manifold of the hydraulics. The flow control solenoid and the pressure limiting valve manifold may control a hydraulic pump of the hydraulics.

DETAILED DESCRIPTION

Figure 1:
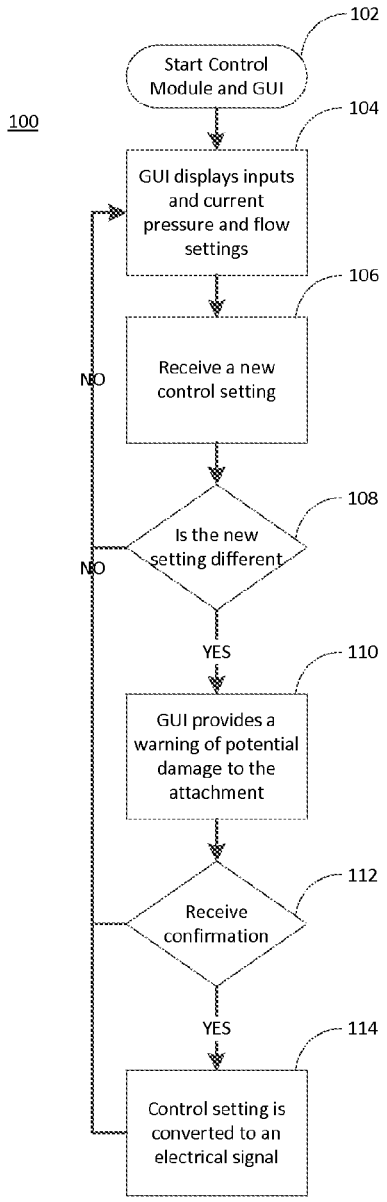
FIG. 1 illustrates a flow chart of an example control operation for a hydraulic circuit.

Described herein is a system that provides a hydraulic flow and pressure control solution that automates adjustments of hydraulic circuits for machines, such as automating adjustments of attachment hydraulic circuits for industrial tractor attachments. The system may include a control module that may include a user interface that provides fields for adjusting the hydraulic circuit without needing make manual adjustments. By making adjustments via a user interface, such as a graphical user interface (GUI), there may be a significant reduction in the time required to change attachments, which in turn increases the productivity of the machine. Increased machine productivity has significant marketability. Additionally, the attachment circuit can be adjusted to accommodate a wide variety of attachments, further increasing a machine's marketability.

The system may include modules and sub-modules that provide functions associated with automation of hydraulic circuit adjustments. Blocks representing functions or modules depicted in the drawings may be implemented in physically separate devices or a single physical device. Such device(s) may include hardware, software, or firmware, for example. Such device(s) may include communication interfaces for communicating with each other and devices external to the system. Such communications may occur via wired or wireless communication paths. Information received from such communications may be stored, processed, and coordinated by many of the modules of the system. Given this, the modules may have corresponding processors and memory devices that may be communicatively coupled with each other and the corresponding communication interfaces.

FIG. 1 illustrates operation 100 for variable control of a hydraulic circuit, such as an industrial tractor attachment hydraulic circuit. A hydraulic circuit may provide control of hydraulic flow and hydraulic pressure to a hydraulically operated mechanism. For example, an attachment hydraulic circuit may provide control of hydraulic flow to an industrial tractor attachment hydraulic circuit, and such a circuit may control hydraulics for a tractor attachment, such as a shovel, snow blower, drill, or other tool. The operation 100 may include selecting a maximum hydraulic pressure and a maximum hydraulic flow to the attachment. Each attachment may use a different maximum hydraulic pressure and maximum hydraulic flow, and such parameters may be regulated by the hydraulic circuit. When an attachment is connected to an industrial tractor, the hydraulic circuit may be configured to drive the attachment. Also, the hydraulic circuit may be configured to prevent damage from excessive hydraulic flow or hydraulic pressure. The hydraulic circuit may be compatible with a quick attach attachment coupling system. A quick attach coupling system may be one or more modules that allow attachments to be connected and disconnected from a machine, such as a tractor, by hydraulically disengaging the pins or the like. Such a system may expedite fastening an attachment, such as a tool.

Figure 2:
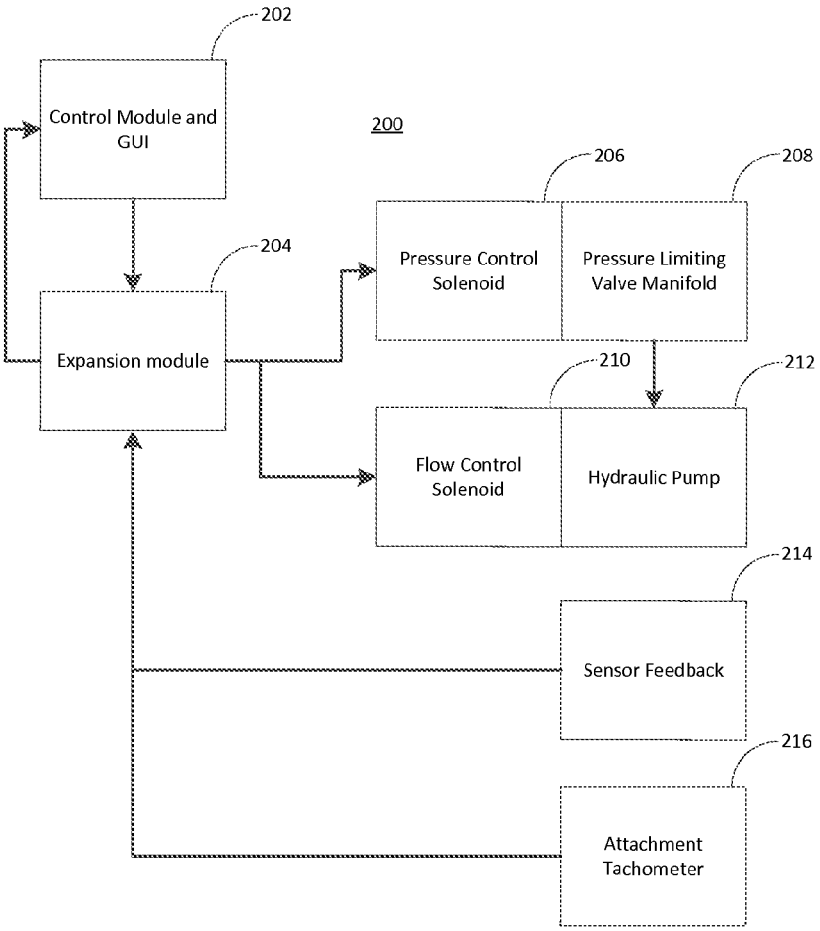
FIG. 2 illustrates a block diagram of an example system for controlling a hydraulic circuit.

With reference to FIGS. 1 and 2, the operation 100 may include, at 102, a control module 202 providing a user interface, such as a graphical user interface (GUI). The user interface provides user input elements so that the user can input control parameters into the control module. Also, the user interface outputs information to the user, so that the user can observe feedback information regarding operations controlled by the control module. At 104, the user interface may provide user input elements so that the user can input control parameters to control the hydraulic pump 212 communicatively coupled to the control module 202. Also, the user interface may output current hydraulic pressure and current hydraulic flow readings, and respective settings to control the hydraulic pressure and hydraulic flow. Attributes of a hydraulic system that may be controlled include hydraulic pressure (e.g., pressure measured in pounds per square inch (PSI)), hydraulic flow (e.g., flow measured in gallons per minute (GPM)), and attachment speed (e.g., speed measured in revolutions per minute (RPM)). The attachment speed may result from the hydraulic pressure and hydraulic flow. Attachment speed in RPM may be displayed when a spinning attachment is used, such as a drill. The control module 202, via the user interface, may also display the current hydraulic pressure, current hydraulic flow, and ramp control settings. The ramp control settings may include a change of hydraulic pressure and/or hydraulic flow over time, and may influence a speed in which the hydraulic system responds to a control setting change. Additional control elements may be provided via the user interface, such as fields and settings for controlling maximum attachment speed, wherein hydraulic flow may be reduced when a maximum attachment speed is exceeded.

At 106, the user interface receives a control setting inputted from the user. The inputted control setting may include a new hydraulic pressure, new hydraulic flow, and/or new ramp control setting. The inputted control setting(s) may be entered when switching between attachments of a mechanism, such as attachments controlled by hydraulics of a tractor. The user may also enter a control setting if the user interface is outputting an insufficient or excessive attachment operation speed, such as displaying insufficient or excessive amount of RPM.

At 108, the control module compares the inputted control setting(s) to corresponding stored control setting(s). The stored control setting(s) may be stored in a memory device included and/or associated with the control module. Included in or associated with the control module, a processor communicatively coupled to the memory device, such as central processing unit, may execute the comparison and other functions performed by the control module. Where the inputted control setting does not match the stored control setting, the control module may provide a warning notification to the user at 110. Where the inputted control setting does match the stored setting, the settings outputted will remain the same at 104.

At 110, the user interface may provide a warning to the user of potential risks to the attachment associated with the new inputted setting(s). A warning may be provided to the user to assist in preventing the user from inadvertently entering a control setting that could damage the attachment.

At 112, the user may be provided, via the user interface, the option to confirm the control setting change. If the user does not confirm the new control setting(s), the method returns to 104 where user interface outputs the stored control setting(s). If the user confirms the inputted control setting(s), the inputted control setting(s) may be stored in the memory device, replacing the previously stored setting(s). The stored setting(s) may be the settings used by the control module to control the hydraulic circuit.

At 114, the control module and/or an expansion module converts the control setting(s) to one or more electrical signals for communication to electromechanical components of the mechanisms associated with the hydraulic circuit, such as solenoid valves that can convert the electrical signal(s) into mechanical signal(s).

In one example of the system, the control module may communicate a control setting to the expansion module. The expansion module may convert the control setting, represented by a digital signal to an analog electric signal. Also, the flow setting represented by binary code may be converted to an electrical current that corresponds to the flow setting. The corresponding electrical current may be used to manipulate a flow control solenoid on the hydraulic pump. Similarly, a pressure setting may be converted to an electrical current that corresponds to the pressure setting. The electrical current corresponding to the pressure setting may be used to manipulate a pressure control solenoid valve on a pressure limiting valve manifold of a hydraulic system.

Further, the current control setting(s) may be increased or decreased over time based on the ramp setting. Upon converting the setting(s) to the corresponding electrical signal(s), the user interface may output the new setting(s), such as the new setting(s) for the current hydraulic pressure and hydraulic flow.

FIG. 2 illustrates a system 200 for variable control of a hydraulic circuit, such as an industrial tractor hydraulic circuit. The system 200 may include a control module 202, an expansion module 204, a pressure control solenoid 206, a pressure limiting valve manifold 208, a flow control solenoid 210, a hydraulic pump 212, sensor feedback 214, and an attachment tachometer 216.

The control module 202 may include a GUI, which may be attached to a structure inside an industrial tractor cabin. The GUI may be mounted in the tractor cabin at an accessible location to an operator of the tractor. A computer program may be stored in a memory device included in or associated with the control module. The control module may include a data communication interface communicatively coupled to a source of the computer program. The interface may receive the computer program or associated data via a wired or wireless medium. Alternatively or additionally, the computer program, or at least part of the program, may be embedded in a circuit of the control module. The user interface associated with the control module may facilitate modifying the computer program.

The control module 202 may be programmed to output, via a user interface, indications of current hydraulic pressure and hydraulic flow settings. Also, the output to the user may include an attachment operation attribute, such as a rotation speed. In such an example, a tachometer 216 may be communicatively coupled to the control module. The computer program may provide logic to control electronic displacement associated with the hydraulic pump and proportional electronic displacement associated with the relief valve in a hydraulic pressure limiting valve manifold. Controlling such displacement may correspond to regulating hydraulic flow or hydraulic pressure adjustment ranges. Control of electronic displacement associated with the hydraulic pump allows the control module to manipulate hydraulic flow. The electronic displacement control may be, may include, or may be associated with a solenoid 210, which may manipulate hydraulic flow based on an electrical current provided to the solenoid by the expansion module 204. The proportional relief valve may also be, include, or be associated with a solenoid 206, which may manipulate hydraulic pressure based on an electrical current provided to the solenoid by the expansion module 204.

Sensor feedback system 214 may provide feedback to the control module and such feedback may be indicated by the GUI, for example. The feedback may also facilitate the control of the hydraulic circuit. Additionally or alternatively, a computer program may calibrated by the hydraulic circuit and its parts by mechanical and/or electrical activation. Also, as the mechanical and electrical components wear, calibration setting(s) may be adjusted so that hydraulic flow and hydraulic pressure can be maintained at a determined safe level. Sensor feedback 214, such as a dedicated flow meter and/or pressure transducer can close a control loop of the system and provide for possible enhancements to the performance of the attachment via closed loop regulation of hydraulic flow and hydraulic pressure. The sensor feedback 214 allows the control module to monitor hydraulic pressure, hydraulic flow, and ramp rate. Where the measured values do not match the control settings, the control module can adjust the corresponding electrical current(s) to account for the disparity.

Expansion module 204 may include hardware, software, and/or firmware to convert the control settings to corresponding electrical current signals. Wiring harnesses may be included in the expansion module that communicatively couples the expansion module to an electronic displacement control module of the hydraulic pump 212 and an electronic displacement control module of the proportional relief valve of the hydraulic pressure limiting valve manifold 208. Additionally or alternatively, the wiring harnesses may be replaced with communicatively coupled wireless transceivers.

Figure 3:
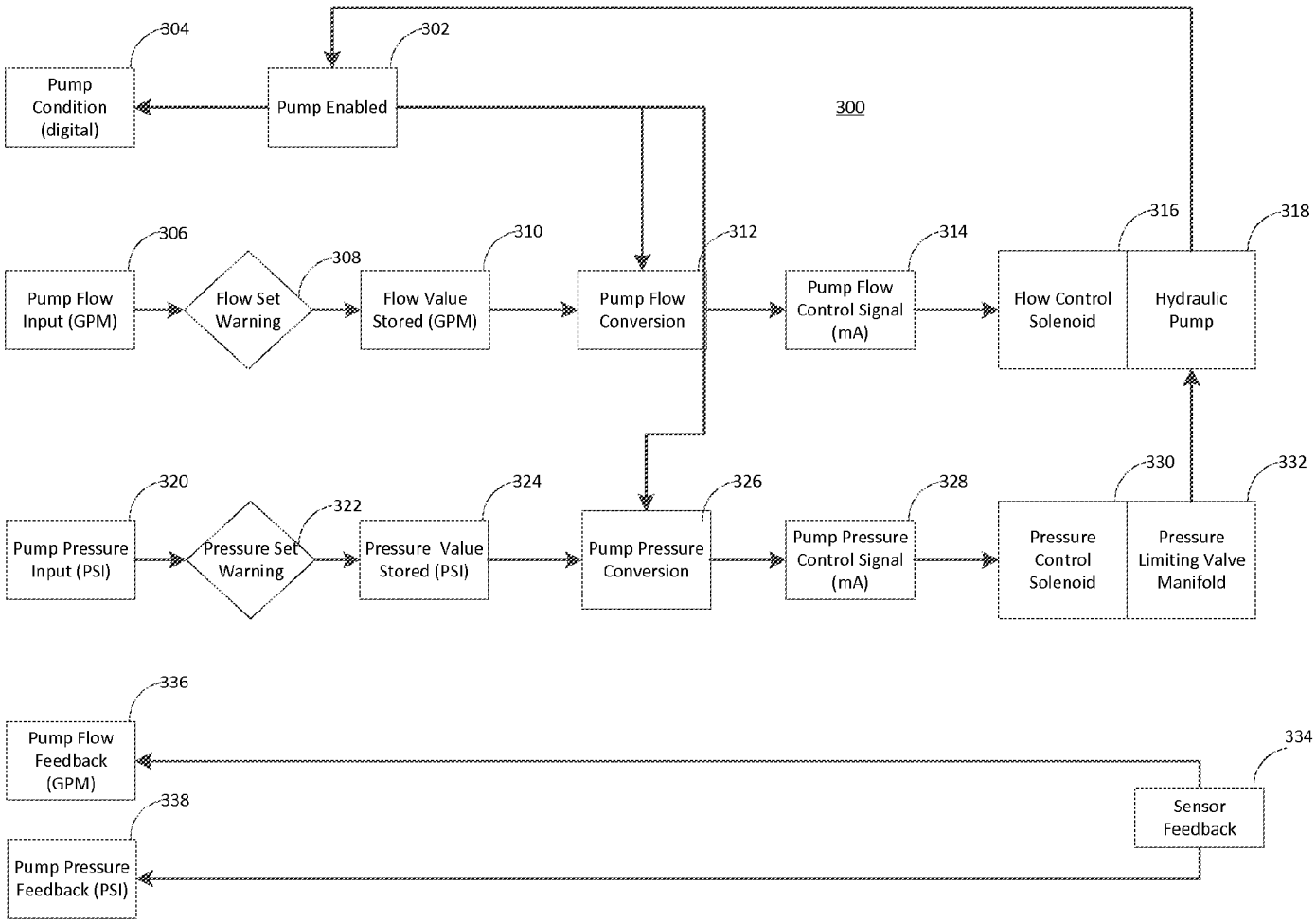
FIG. 3 illustrates another block diagram of an example system for controlling a hydraulic circuit.

FIG. 3 illustrates a system 300 for variable control of a hydraulic circuit, such as a hydraulic circuit of an industrial tractor. Pump enabled module 302 determines whether hydraulic pump module 318 is enabled and determines a pump condition module 304 that can be transmitted to the control module for display. Sensor feedback module 334 provides the hydraulic pressure and hydraulic flow to the control module for display. Pump condition module 304, pump flow feedback module 336 and pump pressure feedback module 338 provide information that can be displayed to the user by a user interface of the control module 202.

The maximum flow of the hydraulic circuit may be controlled by regulating a pump flow control signal at a respective control signal module 314 coupled to the flow control solenoid module 316 associated with the hydraulic pump module 318. The user may select the desired maximum flow by adjusting the pump flow input at a respective input module 306 of the control module 202. The control module 202, via a user interface, may output a flow setting warning for display to a user depending on comparisons performed at a respective module 308. The module 308 may perform the operation at 108 in FIG. 1. Where the user confirms a user inputted pump flow setting, the inputted setting may be stored at or by a storage module 310. Where the pump enabled module 302 indicates that the hydraulic pump module 318 is enabled, pump flow conversion module 312 converts the flow value stored and/or coordinated at module 310 into the corresponding pump flow control signal that may be regulated by a respective module 314. The pump flow control signal module 314 can regulate the control signal that manipulates the flow control solenoid module 316 of the electronic displacement control of the hydraulic pump module 318, in which control of the flow control solenoid varies the pump displacement accordingly. The maximum flow can be adjusted to any flow setting in a range operable by the flow control solenoid module 316 of the electronic displacement control of the hydraulic pump module 318.

A maximum pressure of the hydraulic circuit may be controlled at a pump pressure control signal module 328, where the module 328 may receive instructions from the control module 202 to communicate with the pressure control solenoid module 330. Where the solenoid module 330 may be connect with the proportional relief valve of hydraulic pressure limiting valve manifold module 332. The hydraulic pressure limiting manifold module 332 is coupled with the attachment hydrostatic hydraulic circuit to regulate hydraulic pressure. The user may select the desired maximum operating pressure by adjusting pump pressure at a respect input module 320 of the control module 202. The control module 202 may display a pressure set warning to the user via a warning module 322. Where the user confirms the new pump pressure input via a respective module 320, the pump pressure input may be stored at a pressure value stored module 324. If the pump enabled module 302 indicates that the hydraulic pump module 318 is enabled, pump pressure conversion module 326 converts the pressure value stored and/or coordinated at respective module 324 into the corresponding pump pressure control signal regulated at a respective module 328. The pump pressure control signal module 328 may output a signal that can manipulate the pressure control solenoid module 330 that can be connected to the proportional relief solenoid of the hydraulic pressure limiting valve manifold module 332. The proportional relief solenoid varies the control pressure sent to the hydraulic pump module 318, limiting the maximum pressure accordingly. The maximum pressure can be adjusted to any flow setting in an operable range of the pressure control solenoid module 330 of the proportional relief valve in the hydraulic pressure limiting valve manifold module 332.

FIGS. 4-8 are screens of GUIs that may be provided by the control module 202 during operation 100.

Figure 4:
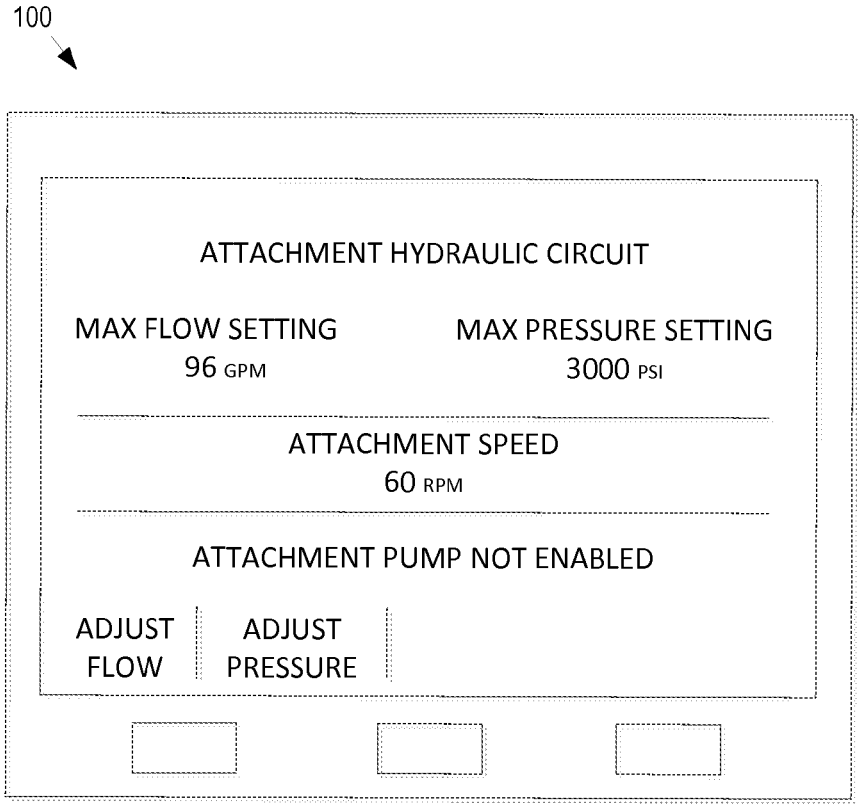
FIGS. 4-8 illustrate screens of a graphical user interface of an example system for controlling a hydraulic circuit.
Figure 5:
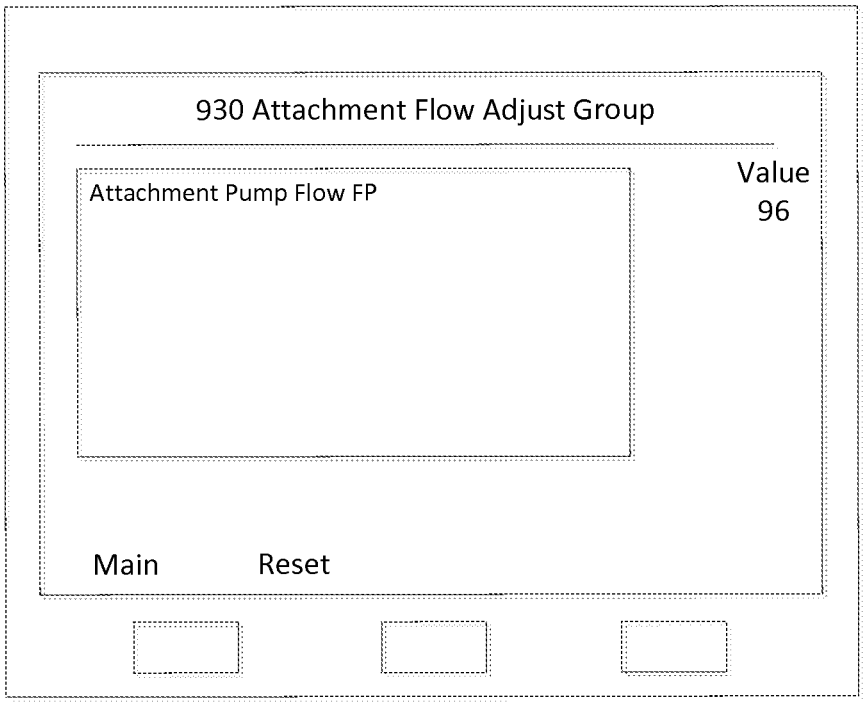
Figure 6:
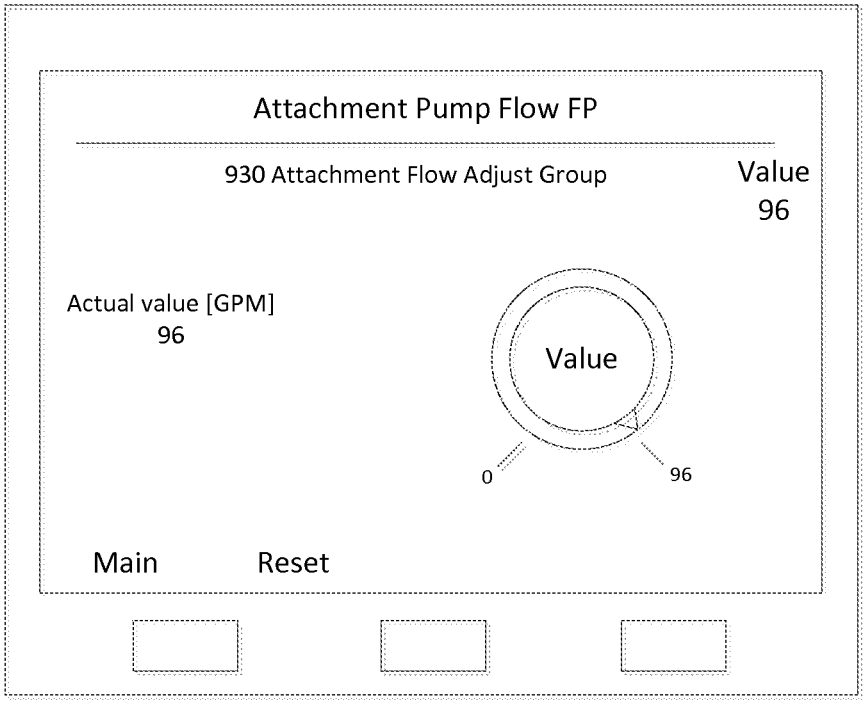
Figure 7:
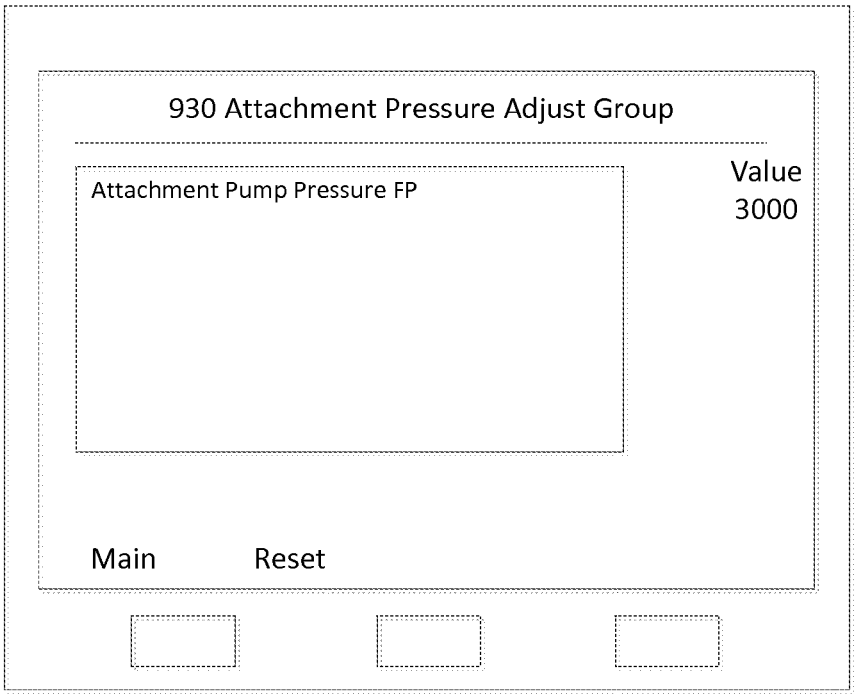
Figure 8:
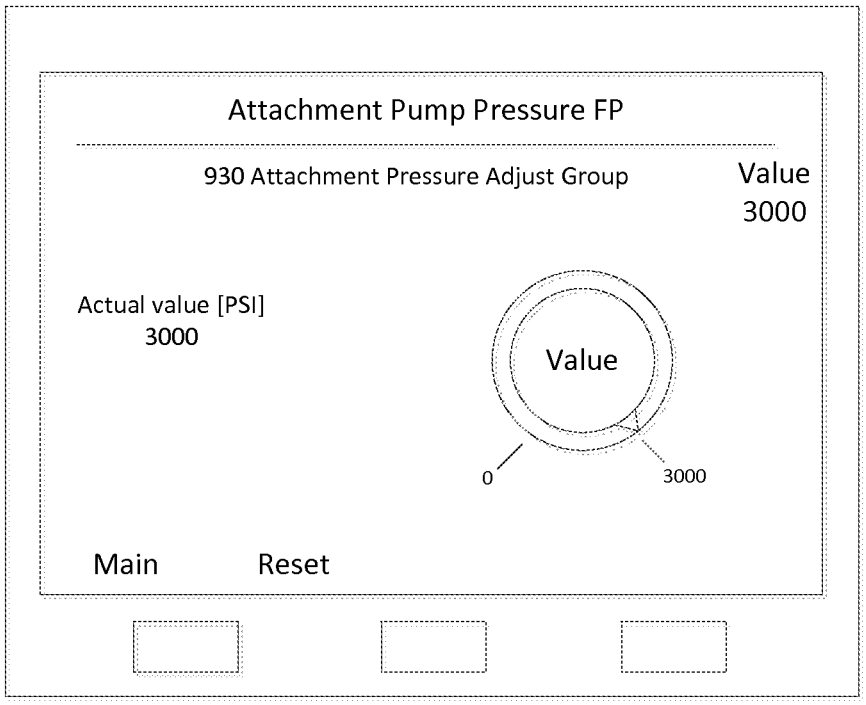

In FIG. 4, a GUI displays input fields, current hydraulic pressure, and hydraulic flow settings, such as at 104. The "maximum flow setting" displayed indicates the current hydraulic flow value stored at the respective storage module 310. The "maximum pressure setting" displayed indicates the current hydraulic pressure value stored at the respective storage module 324. The displayed "attachment speed" indicates speed identified by the attachment tachometer 216. The displayed "attachment pump not enabled" or "attachment pump enabled" indicates status of the pump identified by the pump condition 304. The user may select "adjust flow" or "adjust pressure" to input a new hydraulic control setting from this GUI.

Where the user selects "adjust flow" in FIG. 4, the control module 202 may display another GUI, such as the screen depicted in FIG. 5. In FIG. 5, the illustrated GUI displays an adjustment group, such as the displayed "930 attachment flow adjust group," which may contain one or more settings to control hydraulic flow. The screen in FIG. 5 shows one setting, "Attachment Pump Flow FP," which may be presented via the pump flow input module 306.

Where the user selects "Attachment Pump Flow FP" in FIG. 5, the control module may display a GUI, such as the one depicted in FIG. 6. FIG. 6 displays the current hydraulic flow value stored and/or coordinated at respective module 306. This GUI may also display the pump flow feedback communicated from a respective module 336, denoted as "Actual value (GPM)." FIG. 6 allows the user to enter a new control value corresponding to pump flow input stored and/or coordinated at respective module 306.

Where the user selects "adjust pressure" in FIG. 4, the control module 202 may display another GUI, such as the one depicted in FIG. 7. FIG. 7 displays an adjustment group, such as the displayed "930 attachment pressure adjust group," which may contain one or more settings to control hydraulic pressure. The screen in FIG. 7 shows one setting, "Attachment Pump Pressure FP," which may be presented via the pump pressure input module 320.

Where the user selects "Attachment Pump Pressure FP" shown in FIG. 7, the control module may display the GUI illustrated in FIG. 8. FIG. 8 displays the current pressure value stored and/or coordinated at respective module 324. The pump pressure feedback stored at respect module 338 may also be displayed at a GUI, denoted as "Actual value (PSI)." Such a GUI may also provide a field for the user to enter a new control value corresponding to pump pressure input stored and/or coordinated at module 320.

In one example, the user may select presets and/or set profiles based on the attachment being used. Such presets or profiles may be loaded to the control module or to a corresponding sub-module, such as the modules depicted in FIG. 3. In this example, a control module, such as control module 202, may recognize the attachment being used and may apply the appropriate preset and/or profile corresponding to the attachment.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. An electrical device for controlling a hydraulic circuit, comprising:

a user interface configurable to receive input and display hydraulic control settings, wherein the hydraulic control settings include at least a hydraulic pressure setting and a hydraulic flow setting;

a memory device configurable to store the hydraulic control settings;

a processor executable to convert the hydraulic control settings to corresponding electrical currents, wherein the electrical currents correspond to at least the hydraulic pressure setting and the hydraulic flow setting; and one or more communication interfaces coupled to the processor configurable to output the electrical currents to the hydraulic circuit.

2. The electrical device of claim 1, where the one or more communication interfaces are configured to receive feedback from the hydraulic circuit.

3. The electrical device of claim 2, where the feedback from the hydraulic circuit includes at least a hydraulic pressure and a hydraulic flow of the hydraulic circuit.

4. The electrical device of claim 2, where the processor is executable to use the feedback from the hydraulics circuit to manipulate the electrical currents.

5. The electrical device of claim 1, where the hydraulic circuit controls at least a hydraulic pressure and a hydraulic flow of hydraulic circuit.

6. The electrical device of claim 1, where the hydraulic circuit is embedded in a part of a tractor.

7. The electrical device of claim 6, where the tractor includes a mechanical interface configurable to receive one or more attachments.

8. A method for controlling a hydraulic circuit, comprising:

storing, at a memory device, hydraulic control settings;

displaying, at a user interface, the hydraulic control settings, wherein the hydraulic control settings include at least a hydraulic pressure setting and a hydraulic flow setting;

receiving, at the user interface, user input corresponding to the hydraulic control settings;

comparing, at a processor, the user input to the hydraulic control settings;

outputting, via the user interface, a warning regarding that at least one aspect of the user input is different from a corresponding aspect of the hydraulic control settings;

receiving, at the user interface, user input confirming the difference is acceptable;

converting the hydraulic control settings to corresponding electrical currents, wherein the electrical currents correspond to at least the hydraulic pressure setting and the hydraulic flow setting; and outputting, via a communication interface, the electrical currents to the hydraulic circuit.

9. The method of claim 8, further comprising receiving, via a communication interface, feedback from the hydraulic circuit.

10. The method of claim 9, where the feedback from the hydraulic circuit includes at least a hydraulic pressure and a hydraulic flow of the hydraulic circuit.

11. The method of claim 9, further comprising manipulating the electrical currents based on the feedback from the hydraulic circuit.

12. The method of claim 8, where the hydraulic circuit controls at least a hydraulic pressure and a hydraulic flow within the hydraulic circuit.

13. The method of claim 8, where the hydraulic circuit is embedded in a part of a tractor.

14. The method of claim 13, where the tractor includes a mechanical interface configurable to receive one or more attachments.

15. A system for controlling a hydraulic circuit, comprising:

a control module, the control module including:

a user interface configurable to receive input and display hydraulic control settings, wherein the hydraulic control settings include at least a hydraulic pressure setting and a hydraulic flow setting;

a processor executable to convert the hydraulic control settings to corresponding electrical currents, wherein the electrical currents correspond to at least the hydraulic pressure setting and the hydraulic flow setting; and one or more communication interfaces coupled to the processor configurable to output the electrical currents to the hydraulic circuit;

a pressure control solenoid operable to receive the corresponding electrical current corresponding to the hydraulic pressure setting from the control module;

a flow control solenoid operable to receive the corresponding electrical current corresponding to the hydraulic flow setting from the control module;

a pressure limiting valve manifold controlled by the pressure control solenoid; and a hydraulic pump controlled by the pressure limiting valve manifold and the flow control solenoid.

16. The system of claim 15, where the one or more communication interfaces are configured to receive feedback from the hydraulic circuit.

17. The system of claim 16, where the feedback from the hydraulic circuit includes at least a hydraulic pressure and a hydraulic flow of the hydraulic circuit.

18. The system of claim 16, where the processor is executable to manipulate the electrical currents based on the feedback from the hydraulic circuit.

19. The system of claim 15, where the system is embedded in a tractor.

20. The system of claim 19, where the tractor includes a mechanical interface configurable to receive one or more attachments.

* * * * *